United States Patent [19]

Van Houten et al.

[11] 4,002,945

[45] Jan. 11, 1977

[54] PICTURE DISPLAY DEVICE HAVING A MATRIX OF DIRECT CURRENT GAS DISCHARGE CELLS

[75] Inventors: Sjouke Van Houten; Thijs Johannes De Boer, both of Eindhoven, Netherlands

[73] Assignee: U.S. Philips Corporation, New York, N.Y.

[22] Filed: Sept. 24, 1973

[21] Appl. No.: 399,858

Related U.S. Application Data

[63] Continuation of Ser. No. 243,784, April 13, 1972, abandoned.

[30] Foreign Application Priority Data

Apr. 21, 1971 Netherlands ..... 7105349

[52] U.S. Cl. ..... 315/58; 313/188; 313/220

[51] Int. Cl.[2] ..... H01J 17/34; H01J 61/067; H01J 61/30

[58] Field of Search ..... 313/188, 220; 315/58, 315/169 TV

[56] References Cited

UNITED STATES PATENTS

| | | | |
|---|---|---|---|
| 3,206,638 | 9/1965 | Moore | 315/169 TV X |
| 3,334,269 | 8/1967 | L'Heureux | 315/58 |
| 3,499,167 | 3/1970 | Baker et al. | 313/188 X |
| 3,553,458 | 1/1971 | Schagen | 315/169 R X |
| 3,600,626 | 8/1971 | Kupsky | 313/220 |
| 3,603,837 | 9/1971 | Turner | 313/220 |
| 3,684,918 | 8/1972 | Schmersal | 313/169 TV X |

*Primary Examiner*—Palmer C. Demeo
*Attorney, Agent, or Firm*—Frank R. Trifari; Carl P. Steinhauser

[57] ABSTRACT

A picture display device having a matrix of direct current gas discharge cells. The panel has a stratified structure and is specially suitable for series production. The electrodes are conductors which are provided on the surface of the flat front plate and rear plate, respectively. The cells are constituted by glass foils which are secured to the front plate and rear plate, respectively, and are provided with holes. The conductors preferably comprise a layer of conductive glass. The conductors are peferably suitable for the direct connection to a connecting plug.

5 Claims, 4 Drawing Figures

PICTURE DISPLAY DEVICE HAVING A MATRIX OF DIRECT CURRENT GAS DISCHARGE CELLS

This is a continuation, of application Ser. No. 243,784, filed 4-13-72, now abandoned.

The invention relates to a picture display device having a matrix of direct current gas discharge cells, comprising a transparent front plate, a rear plate parallel to the front plate, two sets of conductors of which the conductors of each set cross the conductors of the other set and which sets of conductors are located in two parallel planes, and means to form the matrix of direct current gas discharge cells between the sets of conductors.

A known picture display device of the above-mentioned type is described in the French Pat. No. 1,582,434 and comprises an electrically insulating intermediate plate which is provided with a matrix of holes to form the gas discharge cells. A set of parallel conductors is provided on either side of said intermediate plate. Both sets of conductors cross each other at right angles and thus constitute a so-called cross-bar system. A conductor of one set and a conductor of the other set together determine unambiguously a given gas discharge cell. Each gas discharge cell can thus be made to luminesce by supplying voltage to two conductors. If the gas discharge itself is to produce visible light, the gas pressure in the picture display device and the conductor configuration should be chosen to be so that a glow discharge is formed.

Picture display devices of the above-mentioned type can reproduce all kinds of information, not only in the form of, for example, digits and letters built up from dots, but also in the form of, for example, television pictures. It is obvious that the development of said picture display devices is thus directed inter alia to series production. The above-mentioned known picture display device is less suitable for series production in connection with the rather thick intermediate plate in which a pattern of holes and/or slots has to be provided.

It is an object of the invention to provide a picture display device which is suitable for series production. A further object of the invention is to provide a picture display device of a simple and cheap construction.

According to the invention, a picture display device of the above mentioned type comprises substantially flat front and rear plates conductors being provided on the surface of the front plate and the rear plate, respectively, on the side facing the other plate and on each plate, on the side facing the other plate, an insulating foil is secured, said foils comprising a matrix of holes to form the cells and partly covering the conductors on the plate.

Such a stratified construction is extremely suitable for series production, in particular because the picture display device according to the invention consists of two substantially identical parts, namely the front plate and the rear plate with the conductors and foils provided thereon. In addition, the cells in the device according to the invention are not closed so that very good pumping paths for evacuating the device are present and substantially the same pressure prevails in each cell during operation. In the known device extra pumping paths should be provided, for example, in the form of slots, which means a complication.

In a picture display device according to the invention the distance between the front plate and the rear plate is preferably at most equal to one third of the smallest distance between the center lines of the conductors of a set.

It is then possible to choose the gas pressure in the device to be such that, in spite of the cells which are not quite closed, no cross-talk occurs between the various cells.

In a picture display device according to the invention, the foils preferably consist of glass and are provided with punched circular or square holes.

The advantage of this is that in certain glass foils on the one hand holes can be punched in a simple manner, while on the other hand they can be baked on the plate with the conductors by means of a simple temperature treatment. A glass foil suitable for this purpose consists of glass powder in a binder. Such a foil can easily be punched and is converted into a thin glass layer during baking while the binder evaporates.

In a particular form of a picture display device according to the invention, the conductors, at least in so far as they are not covered by an insulating foil, are covered by a thin layer of electrical resistance material.

Actually, it is known of glow discharges that the ignition voltage is higher than the operating voltage and that the current through the gas discharge is determined to a considerable extent by the resistor which is connected, in series with the gas discharge, to the supply voltage source. If a resistor were used in series with a conductor, the voltage across said conductor would fall to the operating voltage of the gas discharge as soon as one associated gas discharge cell has been ignited, as a result of which other gas discharge cells associated with said conductor can no longer be ignited. Consequently every gas discharge cell must be connected to the conductor via its own resistor so that the voltage of said conductor is not detrimentally influenced by the operation of one or more gas discharge cells. These resistors are realized in a manner suitable for series production by covering the surface of the conductors which supplies current to the gas discharges with a layer of an electrical resistance material having a given resistivity.

A favourable embodiment of a picture display device according to the invention is such that the front plate and the rear plate are rectangular and the long sides of the rectangle of one plate are parallel to the short sides of the rectangle of the other plate in such manner that each plate comprises a part projecting beyond the other plate, said parts being provided with the conductors and being suitable for connecting a multi-pin connecting plug.

It is obvious that the conductors are advantageously used in this manner to also form the connections. In the contact places with the connecting plug, the conductors may be made slightly thicker for reinforcement or be provided with an extra layer of a metal to reduce the contact resistance.

The invention will be described in greater detail with reference to the accompanying drawing, in which:

FIG. 3 is a part of a sectional view of a second embodiment of a picture display device according to the invention and.

Figure 1:
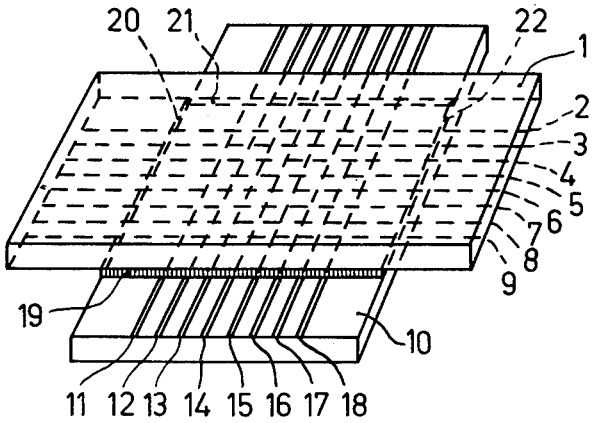
FIG. 1 is a diagrammatic perspective view of the structure of a picture display device according to the invention

The picture display device shown diagrammatically in FIG. 1 comprises a front plate 1 having a set of 8 parallel conductors 2 to 9 and a rear plate 10 having a set of 8 parallel conductors 11 to 18. The cross-overs of the conductors correspond to 8×8=64 gas discharge cells. The plates 1 and 2 are at a short distance from each other and the edges 19, 20, 21 and 22 are made vacuum-tight with pyroceram. The space between the plates 1 and 2 is provided with a suitable gas filling via an aperture not shown. This gas filling consists of 300 Torr neon and 1 Torr hydrogen. The hydrogen is added to reduce the deionization time. Since FIG. 1 serves to show the construction of the picture display device diagrammatically, inter alia the foils are not shown for clarity. This is described in greater detail with reference to FIGS. 2 and 3.

Figure 2:
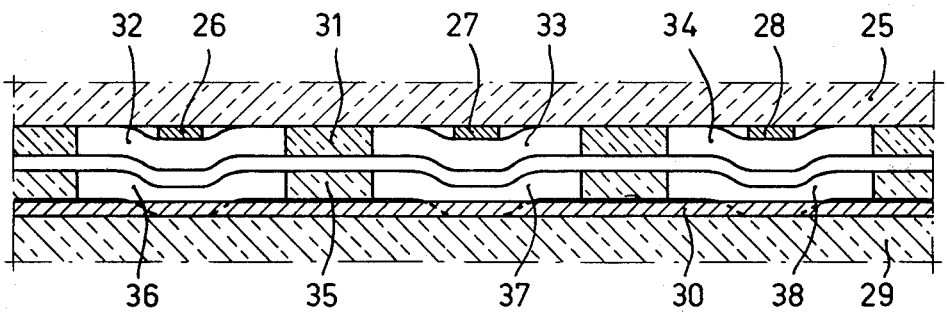
FIG. 2 is a part of a sectional view of a first embodiment

In FIG. 2, the front plate 25 comprises a number of parallel conductors which extend normal to the plane of the drawing and the conductors 26, 27 and 28 of which are visible in the figure. The rear plate 29 also comprises a number of parallel conductors which, however, extend parallel to the plane of the drawing and of which the conductor 30 is intersected by the plane of the drawing. The conductors are manufactured from an alloy of nickel and chromium. The conductors have been etched from a foil and then adhered to the front plate and the rear plate by means of glass enamel. Other methods of providing the conductors such as silkscreening, vapour deposition and sputtering, are also possible, as well as other metals and alloys. The front plate 25 and the rear plate 29 are 6 mm thick. The distances between the plates is 0.30 mm. The conductors are 0.05 mm thick and 0.15 mm wide. A glass foil 31 is provided and baked on the front plate 25. Said glass foil comprises a matrix of holes, of which the holes 32, 33 and 34 are visible in the drawing. The glass foil is 0.10 mm thick, the holes are square and 0.70×0.70 mm and the distance between the centre lines of the holes is 1 mm. The pitch of each set of conductors thus is also 1 mm.

A foil 35 having holes 36, 37 and 38 is also present on the rear plate 29.

Figure 3:
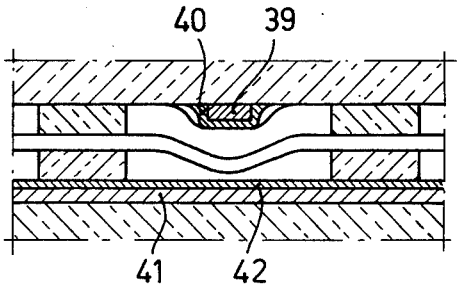
Figure 4:
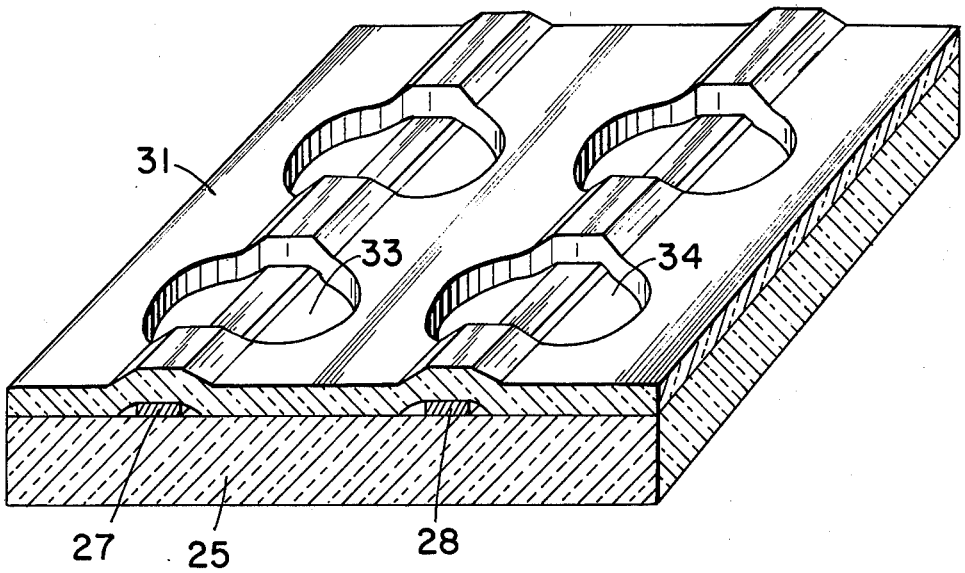
FIG. 4 is an elevational view from the interior of the device.

FIG. 3 shows a part of a sectional view of a particular embodiment of a picture display device according to the invention. The elements of FIG. 2 are recognized again in FIG. 3, however, the conductor 39 is covered with a layer 40 and the conductor 41 with a layer 42. The layers 40 and 42 consist of a conductive glass having such a resistivity that each gas discharge cell is in series with a given electric resistor which enables a gas discharge cell to be ignited when another discharge cell associated with the same conductor has already been ignited.

The embodiment described comprises 64 gas discharge cells. Of course the invention is not restricted to picture display devices having a small number of cells. For television purposes, much larger numbers of cells are necessary and also possible according to the invention. In the case of large panels it is necessary to provide spacing members between the insulating foils in a few places so as to prevent the front plate and the rear plate to be forced towards each other by the atmospheric pressure.

What is claimed is:

1. A picture display device having a matrix of direct current gas discharge cells, comprising a flat panel type envelope containing an ionizable gas and including a substantially flat transparent front plate, a substantially flat rear plate parallel and sealed to the front plate, a first set of conductors on the inner surface of the front plate and a second set of conductors on the inner surface of the rear plate facing and orthognal to the first set of conductors, and means to form the matrix of direct current gas discharge cells between the sets of conductors comprising a single insulating foil secured directly on each plate on the side facing the other plate folded over and partly covering the conductors on said plate, said foils having aligned apertures forming a matrix of holes which form the cells.

2. A picture display device as claimed in claim 1, wherein the distance between the front plate and the rear plate is at most equal to one third of the smallest distance between the center lines of the conductors of a set.

3. A picture display device as claimed in claim 1 wherein the insulating foils consist of glass and are provided with punched circular or square holes.

4. A picture display device as claimed in claim 1 wherein portions of the conductors not covered by the insulating foil are covered by a thin layer of electrical resistance material.

5. A picture display device as claimed in claim 1 wherein the front plate and the rear plate are rectangular and the long sides of the rectangle of one plate are parallel to the short sides of the rectangle of the other plate in such manner that each plate comprises a part projecting beyond the other plate, said parts being provided with the conductors and being suitable for connecting a multi-pin connecting plug.

* * * * *